United States Patent [19]

Tullos et al.

[11] 4,317,491

[45] Mar. 2, 1982

[54] WIRELINE PROTECTOR

[75] Inventors: Homan C. Tullos, Lafayette, La.; Dewey W. Woods, Livingston, Tex.

[73] Assignee: Tullos & Woods Tools, Inc., Lafayette, La.

[21] Appl. No.: 148,393

[22] Filed: May 9, 1980

[51] Int. Cl.[3] ..... E21B 3/04

[52] U.S. Cl. ..... 175/57; 175/104; 175/195; 166/65 R; 174/136

[58] Field of Search ..... 175/57, 195, 104; 166/65 R; 174/135, 136, 152 G; 16/108, 109, 248/49

[56] References Cited

U.S. PATENT DOCUMENTS

| | | | |
|---|---|---|---|
| 2,829,190 | 4/1958 | Comlossy, Jr. | 166/65 R |
| 3,048,358 | 8/1962 | Raulins et al. | 248/49 |
| 4,188,836 | 2/1980 | Muller | 74/501 R |
| 4,194,711 | 3/1980 | Winton | 248/41 |

FOREIGN PATENT DOCUMENTS

| | | | |
|---|---|---|---|
| 1465768 | 5/1969 | Fed. Rep. of Germany | 174/135 |

*Primary Examiner*—William F. Pate, III

*Attorney, Agent, or Firm*—LeBlanc, Nolan, Shur & Nies

[57] ABSTRACT

A wireline protector for protecting an electrical wireline used in a downhole drilling operation. During the operation of adding additional drill string members to the drill string, the electrical wireline is encased by the wireline protector thereby guarding it against damage by any slippage of the slip members. The wireline protector includes an elongated section that is arranged to extend through the opening in the rotary table through which the drill string passes in such a manner so as not to interfere with the drill string and a second section substantially perpendicular to the elongated section. The elongated section has an elongated opening into which the portion of the wireline passing through the rotary table can be inserted so that it is substantially surrounded and guarded by the elongated section. The second section is arranged in engagement with the rotary table so as to maintain the wireline protector in place.

16 Claims, 12 Drawing Figures

Fig. 6
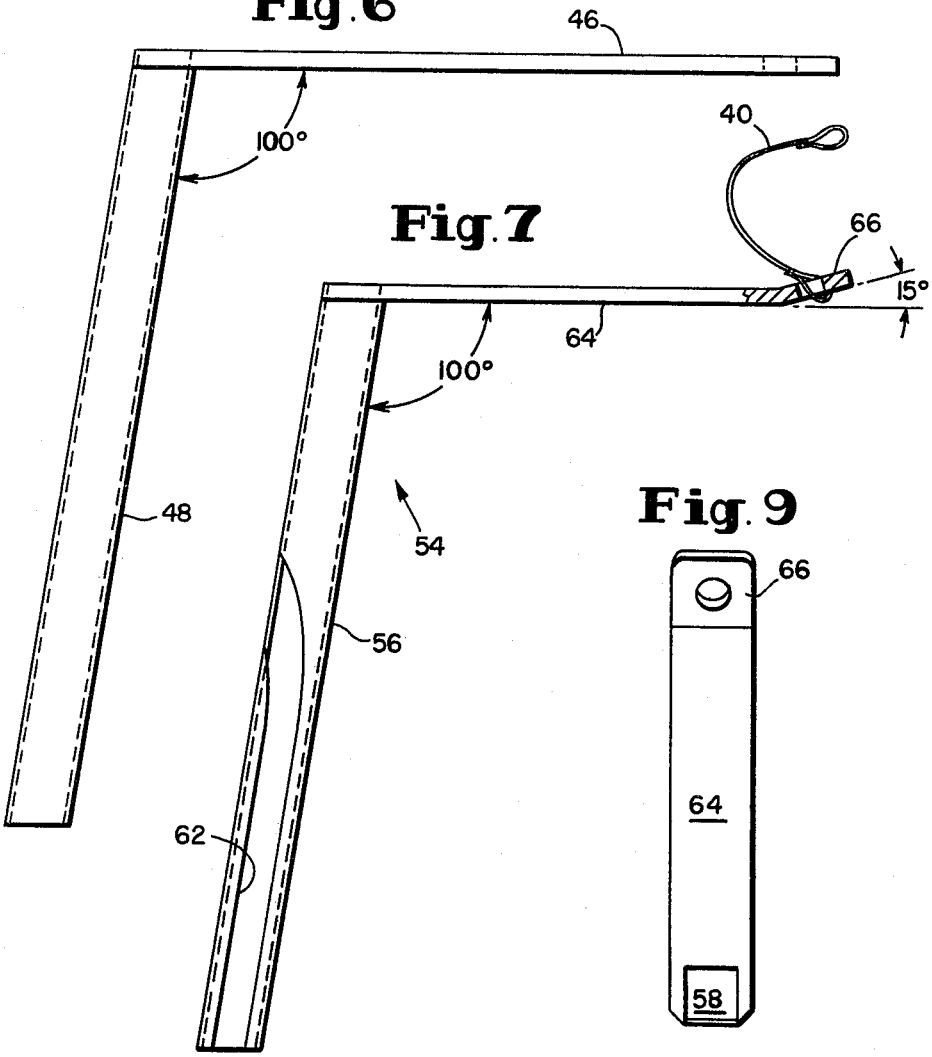
Fig. 7
Fig. 8
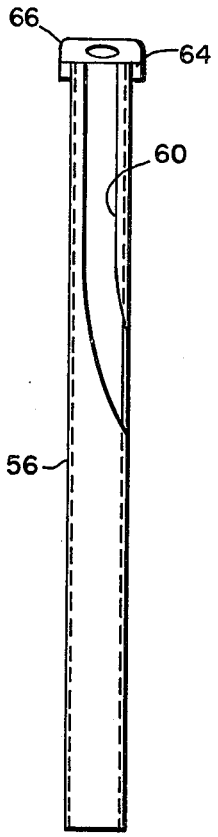
Fig. 9
Fig. 10
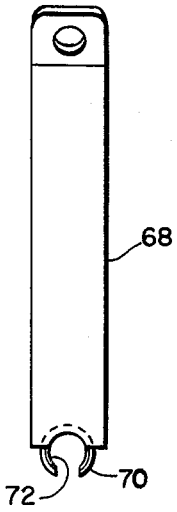
Fig. 11
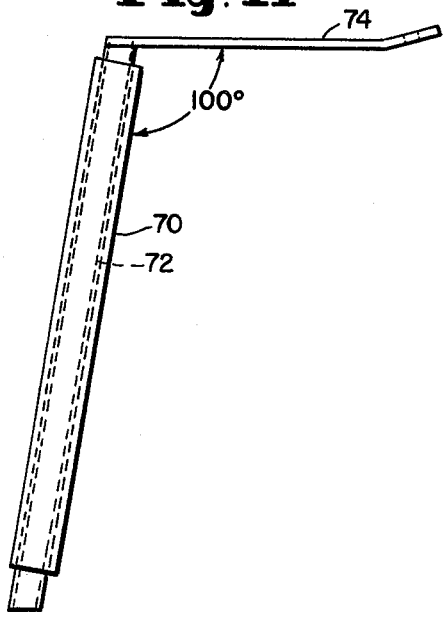
Fig. 12
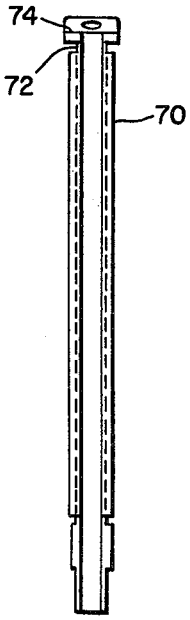

WIRELINE PROTECTOR

BACKGROUND OF THE INVENTION

The present invention relates to equipment for use during a downhole drilling operation.

During a downhole drilling operation, in the area of the downhole drilling bit there is usually arranged an electrical sensing member. This electrical sensing member serves to detect the path of the drilling operation so that appropriate corrections can be made to the drilling operation. An electrical wireline from a supply at the surface extends along the drilling string and is attached to the electrical sensing member. Typically, the wireline extends along the outside of the drilling string for a certain distance from the surface of the earth until it reaches a side entry sub assembly at which point it enters the interior of the drill string and travels through the drill string until it reaches the sensing member. Such side entry sub assemblies are manufactured by Sperry-Sun and are disclosed in U.S. Pat. No. 4,062,551.

The drill string assembly is attached at its upper end to a kelly which passes through a kelly bushing and the opening in the rotary table. As the drill bit advances into the earth, the kelly with the attached drill string moves downwardly with the bit. When the majority of the kelly has entered the hole being drilled, a new drill string member is attached. The drill string and the kelly with the kelly bushing are lifted out of the hole so as to bring the uppermost portion of the top drill string member up through the opening in the rotary table. A plurality of slips are then inserted between the rotary table and the top drill string member so as to secure the top drill string member and the attached drill string assembly to the rotary table. The kelly is then detached from the uppermost drill string member and an additional drill string member is inserted. Typically, two drill string members are inserted at a time. The kelly then is reattached and the drilling operation is continued.

When the top drill string member is secured to the rotary table by the slips, great care must be taken to avoid having any slippage of the slips which can result in damage to the electrical wireline. If the electrical wireline is either pinched or possibly even broken by the slips, the entire wireline must be removed from the drill hole. In order to remove the wireline, the drill string assembly must be removed from the ground until the point of location of the side entry sub assembly. The wireline then is removed and a new wireline inserted. Such an operation results both in having to discard a significant quantity of electrical wire, which can typically be on the order of 10,000 feet, and a time consuming operation for having to replace the electrical wireline. Such damage, therefore, further increases the cost of the drilling operation.

While various devices have been employed for protecting an electrical wireline during a drilling operation, these devices are neither capable nor were they developed for the purpose of resolving the above-described problems. Typical of the devices that have been used in drilling operations are those shown by the following U.S. Pat. Nos.: 2,829,190 to Comlossy and 3,171,889 to McCarthy. The patents to Comlossy and McCarthy both illustrate clamp members that are attached to the drill string. The wireline is arranged within this clamp member and extends along the outer length of the drill string to the area of the drill bit. These devices are primarily designed to prevent the electrical wire from becoming twisted or wrapped around the drill string member as it is rotated and also to protect the wireline from being damaged by the drill string members within the hole being drilled. With the utilization of the side entry sub assembly, however, the electrical wireline passes through the center of the drill string members and hence the clamps disclosed by the patents to Comlossy and McCarthy are not needed.

When drilling under certain conditions, it is necessary to insulate the electrical wire from certain conditions that might occur during the drilling operation. For this purpose, U.S. Pat. No. 3,835,929 to Suman discloses encasing the electrical wireline within a special conduit that extends from the top of the hole being drilled down to the drilling bit along the outside of the drill string assembly. Once again the types of problems that this patent seeks to avoid are largely solved by the use of the side entry sub assembly thereby rendering the use of the insulating tubing unnecessary.

Various other devices have been know in the art for shielding a cable as it passes between two points. Such devices are illustrated in the following U.S. Pat. Nos.: 2,258,745 to Dewey et al.; 2,408,253 to Diebold; and, 3,716,733 to Keith et al. These devices, however, are not utilized in downhole drilling operations.

SUMMARY OF THE INVENTION

An object of the present invention is to avoid the potential damage to the electrical wireline that can occur during the downhole drilling operation as discussed above.

Another object of the present invention is to provide a device for protecting the electrical wireline from damage during the operation of adding additional drill string members to a drill string assembly utilized in a downhole drilling operation.

A further object of the present invention is to provide a wireline protector that will prevent the slips from touching the electrical wireline and cutting or pinching such wireline.

In order to achieve the objectives of the present invention, a wireline protector is utilized during the operation of adding additional drill string members to the drill string assembly. This wireline protector encases the electrical wireline thereby preventing the slips from touching the wireline and cutting or pinching such line.

The electrical wireline protector includes an elongated section and a top section which is oriented so as to be approximately perpendicular to the elongated section. Preferably, the two sections should be respectively oriented so as to encompass an angle of slightly greater than 90°, ideally approximately 100°. The elongated section is the section that is arranged in the opening in the rotary table through which the drill string passes and is arranged within such opening so as to avoid being in interference with the drill string. The elongated section has an elongated opening into which the portion of the electrical wireline that passes through the rotary table can be inserted so as to be substantially surrounded by the elongated section. The top section lies on top of the rotary table in engagement with the rotary table and thereby maintains the wireline protector in place, i.e. prevents the wireline protector from sliding through the opening in the rotary table. In order to avoid any rotational movement of the wireline protector, the circumference of the elongated section should preferably be noncircular. The use of a noncircular circumference for the elongated section avoids any tendency of the wireline protector to roll within the opening in the rotary table.

The elongated opening in the elongated section can take any one of several different forms. This elongated opening can have a cross-sectional shape of a parallelogram. Alternatively, the cross-sectional shape of the elongated opening can be circular. While the access to the elongated opening can extend along a straight line, the path of the access can turn. If the access to the elongated opening does turn, preferably it turns by approximately 90°. Utilizing an embodiment where the access to the elongated opening does turn enables the wireline protector to be inserted into the opening and to then have at least some portion of the elongated section entirely wrapped around the electrical wireline thereby helping to ensure that it does not slip out of the elongated section.

During the downhole drilling operation, when additional drill string members are to be added to the drill string assembly the electrical wireline protector of the present invention is utilized. The drill string assembly includes: the downhole drilling motor, an electrical sensing member, a drill string having at least one drill string member, a kelly attached to the upper end of the drill string, a rotary table having an opening through which the kelly and the drill string extend, and a supply of electrical wireline. The electrical wireline extends through the opening in the rotary table.

During the operation of adding additional drill string members, the kelly and the attached drill string are raised a sufficient distance that the top portion of the uppermost drill string member extends through the opening in the rotary table. A plurality of slip members are then inserted between the rotary and the drill string so as to secure the drill string to the rotary table. The wireline protector then is inserted through the opening in the rotary table with the electrical wireline being arranged in the elongated opening in the elongated portion of the wireline protector. The kelly then is detached from the uppermost drill string member and a new drill string member inserted between the kelly and the top drill string member. The wireline protector is retained in its position extending through the opening in the rotary table during this entire operation. After the new drill string member has been secured in place and the kelly attached, the drilling operation is continued. Upon resuming the drilling operation, the wireline protector is removed.

BRIEF DESCRIPTION OF THE DRAWINGS

FIG. 6 is a side elevational view of the wireline protector illustrated in FIG. 4.

FIG. 7 is a side elevational view of the wireline protector of the present invention.

FIG. 8 is a front elevational view of the wireline protector of FIG. 7.

FIG. 9 is a top plan view of the wireline protector of FIG. 7 with the elongated portion being arranged perpendicular to the plane of the paper.

FIG. 10 is a top plan view of a third embodiment of the wireline protector of the present invention with the elongated portion being arranged perpendicular to the plane of the paper.

FIG. 11 is a side elevational view of the wireline protector illustrated in FIG. 10.

FIG. 12 is a front view of the wireline protector illustrated in FIG. 10.

DESCRIPTION OF THE PREFERRED EMBODIMENTS

Figure 1:
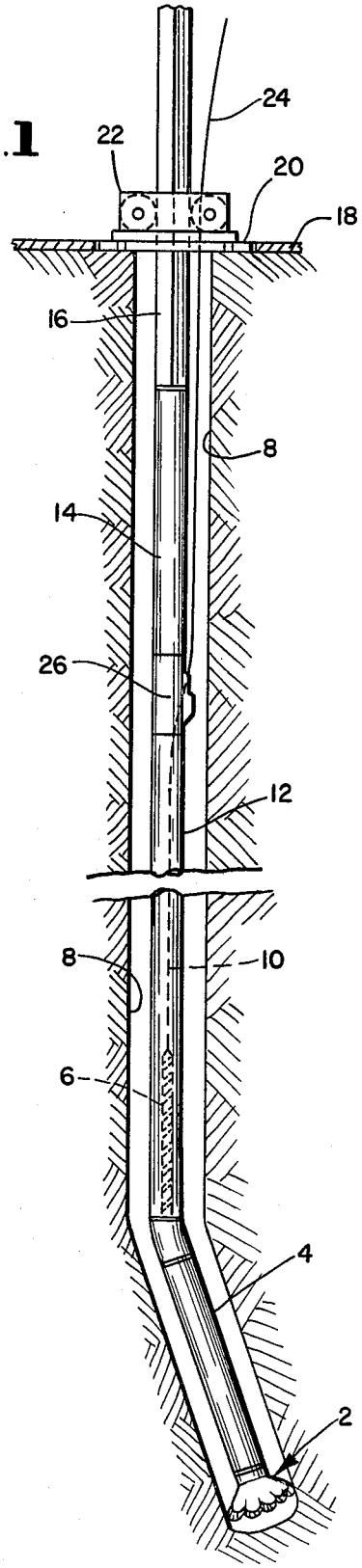
FIG. 1 is a schematic view of a downhole drilling system with which the present invention is utilized.

An exemplary downhole drilling system such as typically utilized in a directional drilling operation for correcting the alignment of the drilling path is illustrated in FIG. 1. At the bottom of the system is the drilling bit 2 that is driven by a downhole motor 4. Positioned immediately above the downhole motor is a sensing device 6 which senses the direction of movement of the drill bit so that signals can be fed back to the drill operators for correcting the path followed by the drill bit. The downhole motor is attached to the surface by a plurality of drill string members such as member 14 which form a drill string 12. The drilling assembly is shown within a drilled well bore hole 8 in the earth in FIG. 1.

The drill string assembly is driven by a kelly 16 which is held by a kelly bushing 22. Kelly bushing 22 is mounted on top of a rotary table 20. Rotary table 20 has an opening 42 through which the kelly passes so as to enter the drilled well bore 8. Rotary table 20 is arranged within rig floor 18. Since kelly 16 is secured against any relative rotational movement with respect to kelly bushing 22, by rotating the rotational table 20 and hence kelly bushing 22, kelly 20 is simultaneously rotated.

During the downhole drilling operation, an electrical wireline 24 is connected to sensing device 6 for supplying signals to and receiving signals back from the sensing device. Electrical wireline 24 passes through the opening in the rotary table so as to travel along well bore hole 8. Electrical wireline 24 enters the drill string assembly through a side entry sub assembly 26. The electrical wireline then travels through the drill string assembly until it is hooked up to sensing device 6. That portion of the electrical wireline passing through the drill string is designated as electrical wireline 10 in FIG. 1.

Figure 2:
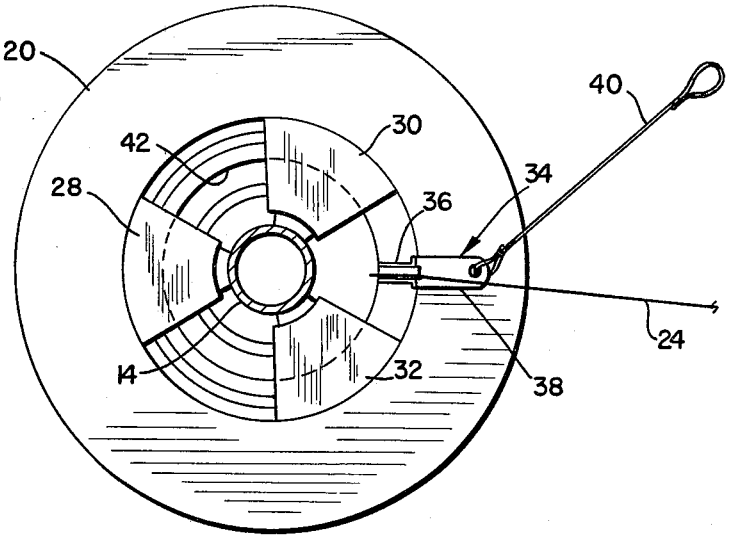
FIG. 2 is a top plan view of a rotary table with the wireline protector of the present invention inserted through the opening in the table.
Figure 3:
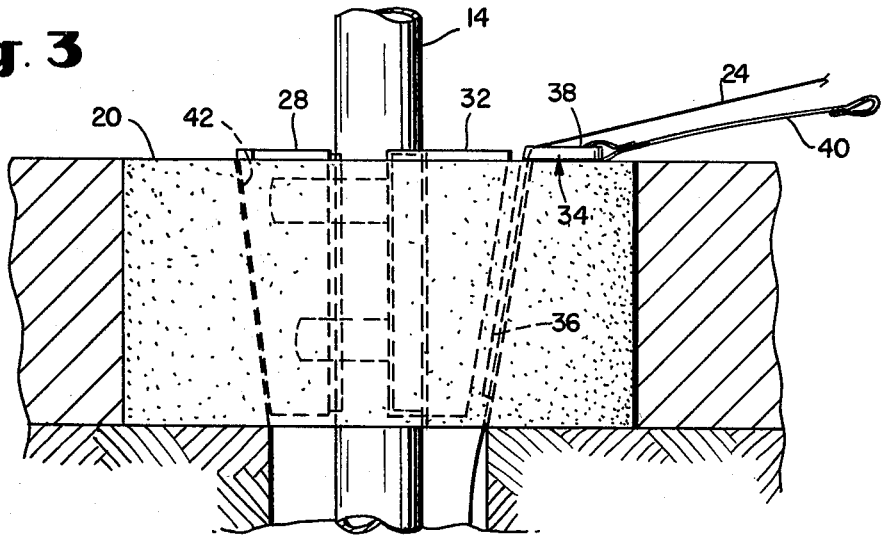
FIG. 3 is a cross-sectional side view of the rotary table with the inserted wireline protector of FIG. 2.

During the drilling operation, the entire drill string assembly including the kelly advances into the hole being drilled. When the top portion of the kelly reaches the kelly bushing, additional drill string members must be added. For this purpose, the kelly along with the kelly bushing are retracted so as to draw the drill string assembly up from the well bore hole being drilled. The kelly is retracted until the uppermost portion of the top drill string member passes through the rotary table. A plurality of slip members 28, 30 and 32, as shown in FIG. 2, are inserted in the opening in the rotary table so as to secure drill string member 14 to the rotary table. The opening 42 in the rotary table preferably has a conical shape with the smaller portion being at the bottom, as shown in FIG. 3, and the slip members similarly should be conically shaped. With such a formation, the weight of the drill string assembly results in a force in a downward direction that creates a stronger attachment between the slip members and the inner walls of opening 42 in the rotary table so that the drill string assembly is securely fastened to the rotary table.

After the drill string assembly has been securely fastened to the rotary table, a wireline protector 34 is inserted and electrical wireline 24 is placed within the elongated portion of wireline protector 34. By inserting electrical wireline 24 in elongated portion 36 of wireline protector 34, electrical wireline 24 is effectively encased so that it is protected against any slippage of the slip members.

In order to prevent the wireline protector from slipping through the opening in the rotary table, attached to elongated section 36 is a top section 38. Top section 38 extends approximately perpendicular to elongated section 36. Top section 38 rests on top of the rotary table and elongated section 36 extends along the inner conically shaped wall of the rotary table as shown in FIG. 3. In order to make it easier to withdraw wireline protector 34 when the drilling operation is resumed, a rope or chain 40 is attached to the end of top section 38 of the wireline protector.

Once the wireline protector is inserted into opening 42 in the rotary table, in order to prevent any rotational movement of the wireline protector, it is desirable to make the outer circumference of the elongated section in the form of a parallelogram so that the sides are flat. Such a form for the elongated section inhibits any rotational movement of the wireline protector.

After the kelly has been detached from the uppermost portion of the top drill string member and the wireline protector inserted in place, the additional drill string members are added. After they are tightly secured between the kelly and the drill string assembly, the slips are removed and the drilling operation is resumed. Upon resuming the drilling operation, the wireline protector can be removed from opening 42 in the rotary table.

Figure 4:
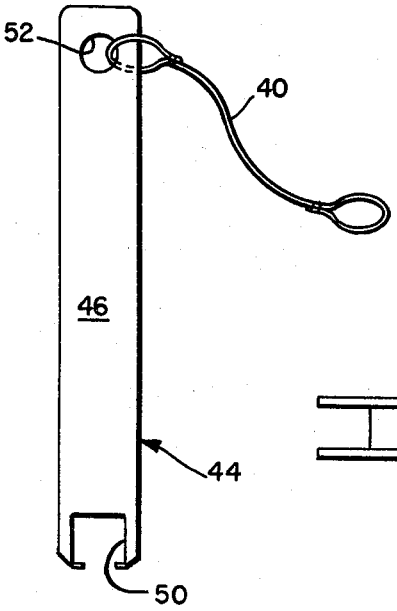
FIG. 4 is a top plan view of one embodiment of the wireline protector of the present invention with the elongated portion being arranged perpendicular to the plane of the drawing.
Figure 5:
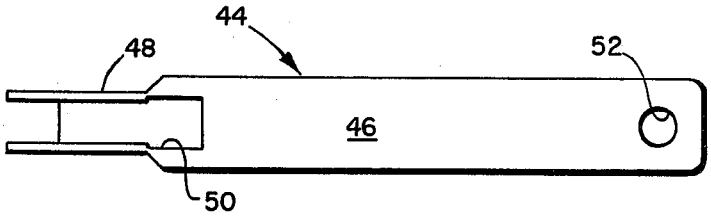
FIG. 5 is a top plan view of the wireline protector of FIG. 4 with the top section being arranged parallel to the plane of the drawing.

A first embodiment of a wireline protector is illustrated in FIGS. 4, 5 and 6. Wireline protector 44 has a top section 46 and an elongated section 48. Elongated section 48 has a square opening 50, as shown in FIG. 4. In top section 46 at the end opposite the location of the elongated section there is an opening 52 through which a chain 40 can be inserted. Top section 46 and elongated section 48 are arranged so as to encompass an angle of approximately 100°, as shown in FIG. 6.

The wireline protector of the present invention is primarily constructed utilizing either steel or plastic tubing sections. While the dimensions can be varied, the following dimensions are set forth as exemplary and are the preferred dimensions with respect to the embodiment illustrated in FIGS. 4 through 6 of the wireline protector. Elongated member 48 should be sufficiently long so as to extend through the entire length of opening 42 in the rotary table. Typically, elongated section 48 would extend for this purpose approximately 13 inches. The square opening 50 in elongated section 48 should be approximately ½ inch wide. The access opening into opening 50 is slightly smaller and would be approximately 7/16 inches wide. Top section 46 of wireline protector 44 can extend approximately 8 to 12 inches and be approximately 1½ inches wide. Opening 52 through which chain 40 passes has a diameter of ⅜ inches. The thickness of top section 46 is approximately ¼ inch. The outer dimension of elongated secton 48 is ¾ inches.

An alternative embodiment 54 of the wireline protector is illustrated in FIGS. 7, 8 and 9. Wireline protector 54 has an elongated section 56 with an elongated opening 58. Elongated opening 58 has a top portion 60 and a bottom portion 62. The access opening to top portion 60 and bottom portion 62 turns by 90° along the length of the elongated section such as shown in FIGS. 7 and 8. Thus, once the electrical wireline is inserted into the opening, it is covered at least some portion along the length on all sides. This helps to ensure that the wireline is retained within elongated section 56. This wireline protector 54 has a top section 64 with a connector section 66. Connector section 66 is bent upwardly by an angle of approximately 15° so that it is slightly spaced from the top of the rotary table.

In another alternative embodiment 68 of the wireline protector, as shown in FIGS. 10 through 12, two circular tubes 70 and 72 are used in constructing the elongated section of wireline protector 68. The inner tube 72, which has the smaller inner and outer dimensions, is attached to top section 74 of wireline protector 68. Outer tube 70 is then arranged so as to surround inner tube 72 in such a manner so that it can be rotated relative to the inner tube. In use, after the electrical wireline has been inserted into the opening of inner tube 72 through the access opening, outer tube 70 is partially rotated so as to close off the access opening. Thus, the electrical wireline is totally surrounded on all sides. The arrangement of the tubes, 70 and 72 are illustrated in FIGS. 10, 11 and 12.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A wireline protector for protecting an electrical wireline used in a downhole drilling operation where such wireline passes through the opening in a drilling rotary table through which the drill string passes, said wireline protector comprising: an elongated section capable of extending through the opening in the rotary table without interfering with the drill string, said elongated section having an elongated opening into which the portion of the wireline passing through the rotary table can be inserted so as to be substantially surrounded by said elongated section for protecting the wireline; and a second flat section extending from the top of and along an axis lying approximately perpendicular to the axis along which said elongated section extends and said second section being capable of being arranged in engagement with the rotary table for maintaining said wireline protector in place.

2. A wireline protector according to claim 1 wherein the circumference of said elongated section is non-circular so as to avoid any tendency for said wireline protector to roll within the opening in the rotary table.

3. A wireline protector according to claim 2 wherein said second section and said elongated section are respectively oriented so as to encompass an angle of approximately 100°.

4. A wireline protector according to claim 1, 2 or 3 wherein the cross-sectional shape of said elongated opening is a parallelogram.

5. A wireline protector according to claim 1, 2 or 3 wherein the cross-sectional shape of said elongated opening is circular.

6. A wireline protector according to claim 1, 2 or 3 wherein the access of said elongated opening extends along a path that turns between the two longitudinal ends of said elongated section.

7. A wireline protector according to claim 6 wherein said path turns by approximately 90°.

8. A method for adding drill string members in a downhole drilling assembly, such assembly including: a downhole drilling motor, an electrical sensing member, a drill string having at least one drill string member, a kelly attached to the upper end of the drill string, a rotary table having an opening through which the kelly and the drill string extend, and a supply of electrical wireline, which wireline extends through the opening in the rotary table; the method comprising the steps of: raising the kelly and the drill string when another drill string member is to be attached, with the drill string being raised sufficiently so that the top portion of the uppermost drill string member extends through the opening in the rotary table; inserting slip members between the uppermost drill string member and the rotary table for securing the drill string to the rotary table; inserting a wireline protector through the opening in the rotary table, such wireline protector having an elongated opening; placing the portion of the electrical wire extending through the opening in the rotary table into the elongated opening in the wireline protector for protecting the electrical wire from the slip members and the drill string.

9. A method according to claim 8 further comprising the step of retaining the electrical wire in the wireline protector while a drill string member is being attached.

10. A method according to claim 9 further comprising the step of removing the wireline protector after the additional drill string member has been attached.

11. A wireline protector for protecting an electrical wireline used in a downhole drilling operation where such wireline passes through the opening in a drilling rotary table through which the drill string passes, said wireline protector comprising: an elongated section capable of extending through the opening in the rotary table without interfering with the drill string; said elongated section including a first hollow tube with an elongated access opening through which the portion of the wireline passing through the rotary table can be inserted so as to be substantially surrounded by said elongated section and a second tube surrounding said first tube and capable of being rotated for blocking said elongated access opening so that the portion of the wireline is entirely encased; and a second section extending approximately perpendicularly to said elongated section and capable of being arranged on the rotary table for maintaining said wireline protector in place.

12. A wireline protector according to claim 11 wherein said second section and said elongated section are respectively oriented so as to encompass an angle of approximately 100°.

13. A wireline protector for protecting an electrical wireline used in a downhole drilling operation where such wireline passes through the opening in a drilling rotary table through which the drill string passes, said wireline protector comprising: an elongated section capable of extending through the opening in the rotary table without interfering with the drill string, said elongated section having an elongated opening into which the portion of the wireline passing through the rotary table can be inserted so as to be substantially surrounded by said elongated section for protecting the wireline, an elongated access opening for enabling the wireline to be inserted into said elongated opening and said access opening of said elongated opening extends along a path that turns between the two longitudinal ends of said elongated section; and a second section extending along an axis approximately perpendicular to the axis along which said elongated section extends and said second section being capable of being arranged on the rotary table for maintaining said wireline protector in place.

14. A wireline protector according to claim 13 wherein the circumference of said elongated section is non-circular so as to avoid any tendency for said wireline protector to roll within the opening in the rotary table.

15. A wireline protector according to claim 14 wherein said second section and said elongated section are respectively oriented so as to encompass an angle of approximately 100°.

16. A wireline protector according to claim 15 wherein the cross-sectional shape of said elongated opening is a parallelogram.

* * * * *